US005736662A

United States Patent [19]

Spector

[11] Patent Number: 5,736,662

[45] Date of Patent: Apr. 7, 1998

[54] HYBRID ELECTRONIC AND ACOUSTIC MUSICAL INSTRUMENT

[76] Inventor: Donald Spector, 380 Mountain Rd., Union City, N.J. 07080

[21] Appl. No.: 777,457

[22] Filed: Dec. 30, 1996

[51] Int. Cl.[6] ..... G10H 7/00

[52] U.S. Cl. ..... 84/600; 84/330; 84/171; 84/385 R; D17/10

[58] Field of Search ..... 84/600, 380, 380 A–380 C, 84/385 R, 171, 330; D17/10, 11, 13, 99

[56] References Cited

U.S. PATENT DOCUMENTS

| | | | |
|---|---|---|---|
| 3,438,298 | 4/1969 | Thompson . | |
| 4,342,244 | 8/1982 | Perkins | 84/171 X |
| 4,527,456 | 7/1985 | Perkins et al. | 84/662 X |
| 5,145,447 | 9/1992 | Goldfarb . | |
| 5,248,843 | 9/1993 | Billings | 84/609 |

*Primary Examiner*—William M. Shoop, Jr.
*Assistant Examiner*—Jeffrey W. Donels
*Attorney, Agent, or Firm*—Michael Ebert

[57] ABSTRACT

A hybrid electronic and acoustic musical instrument whose main section has an animal-like form, such as that of a cat or dog. Extending from the rear of the main section is a hollow tail section terminating in a mouthpiece and provided with a series of finger holes whereby the tail section functions as a recorder instrument. A series of push-button switches mounted on the animal-like body of the main section is connected to a Read-Only-Memory (ROM) housed in this body. Digitally stored in the ROM is a series of different recorded sounds similar to those which the animal represented by the main section is capable of producing, such as barks or meows but in quasi-musical form. When a particular push-button switch is depressed, the related digitally-stored sounds are read out of the ROM and converted to an analog signal which is amplified and reproduced. Thus by blowing into the mouthpiece and selectively fingering the finger holes on the tail sections and the push-buttons on the main section, a player can combine the recorder tones from the tail section with the sounds produced by the main section to create musical effects.

8 Claims, 2 Drawing Sheets

HYBRID ELECTRONIC AND ACOUSTIC MUSICAL INSTRUMENT

BACKGROUND OF THE INVENTION

1. Field of Invention

This invention relates generally to toy musical instruments, and more particularly to a toy musical instrument which is a hybrid of an electronic and an acoustic musical instrument.

2. Status of Prior Art

The concern of the present invention is with musical instruments which a child having little formal training is capable of playing. Thus no child, lacking training, is capable of playing in an acceptable manner a string instrument, such as a violin. But an acoustic instrument that a child with little training is capable of adequately playing is the recorder. This instrument which is in the flute family, has eight finger holes and a whistle-like mouthpiece. A child blowing into the mouthpiece and fingering the holes will not find it difficult to produce different tones of good quality.

Electronic instruments are known that are easy for a child to operate and are capable of functioning in the manner of a finger-operated acoustic instrument to produce different tones. Thus the various tones of a recorder can be recorded and stored in different stages of a Read-Only-Memory (ROM). A ROM is an integrated circuit providing a non-volatile memory which retains whatever data is digitally stored therein even when power is removed.

If therefore there is a digitally stored in various stages of a ROM the series of different tones produced by a recorder, then by means of a like series of finger-operated switches, one can read out each of these tones from the ROM, and read-out tone can be converted into an analog signal which can then be amplified and reproduced.

SUMMARY OF INVENTION

In view of the foregoing, the main object of this invention is to provide a hybrid musical instrument in which a finger-operated acoustic instrument is integrated with a finger-operated electronic instrument so that the player can with his fingers combine the sounds of both instruments to create novel musical effects.

More particularly, an object of this invention is to provide a hybrid instrument in which the acoustic section thereof functions as a recorder and in which the electronic section thereof functions to produce sounds which suggest sounds produced by an animal, such as a cat or dog.

A significant feature of the invention is that the hybrid instrument has the appearance of an animal, such as the cat or dog, the tail of which is configured to function as a recorder, the body functioning as an electronic instrument.

Briefly stated, these objects are accomplished by a hybrid electronic and acoustic musical instrument whose main section has an animal-like form, such as that of a cat or dog. Extending from the rear of the main section is a hollow tail section terminating in a mouthpiece and provided with a series of finger holes whereby the tail section functions as a recorder instrument. A series of push-button switches mounted on the animal-like body of the main section is connected to a Read-Only-Memory (ROM) housed in this body.

Digitally stored in the ROM is a series of different recorded sounds similar to those which the animal represented by the main section is capable of producing, such as barks or meows, but in a quasi-musical form. When a particular push-button switch is depressed, the related digitally-stored sounds are read out of the ROM and converted to an analog signal which is amplified and reproduced. Thus by blowing into the mouthpiece and selectively fingering the finger holes on the tail sections and the push-buttons on the main section, a player can combine the recorder tones from the tail section with the sounds produced by the main section to create musical effects.

BRIEF DESCRIPTION OF DRAWING

For a better understanding of the invention as well as other objects and further features thereof, reference is made to the following detailed description to be read in conjunction with the accompanying drawings, wherein.

DESCRIPTION OF INVENTION

Figure 1:
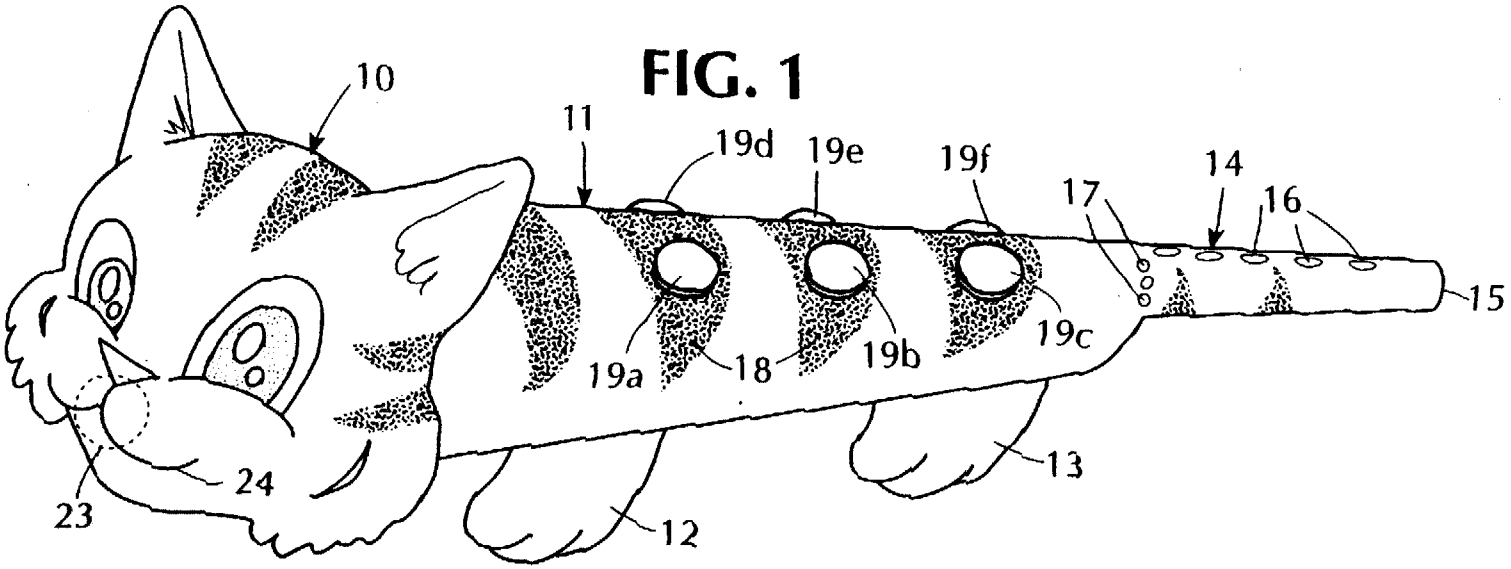
FIG. 1 illustrates a hybrid musical instrument in accordance with the invention that has the appearance of a cat.

First Embodiment:

Referring now to FIG. 1, there is shown a hybrid musical instrument in accordance with the invention which has the appearance of a cat having a head 10, a body 11 provided with front and rear paws 12 and 13, and an elongated tail 14 extending from the rear of the body. In practice, the entire animal-like instrument may be molded of rigid, high-strength synthetic plastic material, such as polyethylene.

Tail 14 constitutes the acoustic instrument section of the hybrid instrument which functions as a recorder. Elongated tail section 14 is hollow and terminates in a whistle-like mouth piece 15, the tail section being provided with a series of finger holes 16. The junction between the body 11 and tail section 14 is formed by a circumferential series of ports 17 that function as the horn or outlet of the acoustic instrument.

Thus a child blowing the recorder through its mouthpiece 15 and fingering finger holes 16 can produce the natural tones of a recorder. While a standard recorder has eight finger holes, the instrument shown in FIG. 1 may have a lesser number, such as five or six, for it is not necessary to produce all of the tones of a standard recorder.

Cat-like body 11 of the instrument is provided with stripes 17 or other marking to simulate the markings of an actual cat. Mounted within these markings on opposite sides of the body are six push-button switches **19*a* to 19*f*. Switches 19*a*, 19*b* and 19*c* are positioned on one side of body 11, while switches 19*d*, 19*e* and 19*f*** are positioned on the other side.

Figure 2:
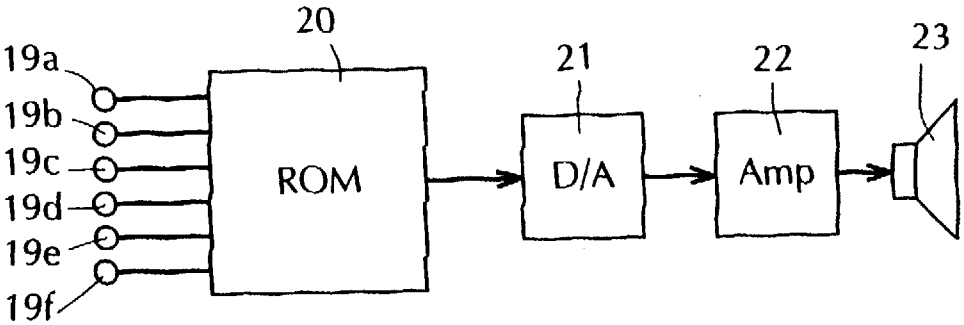
FIG. 2 is a block diagram of the electronic instrument included in the hybrid instrument.

Housed within body 11, as shown in FIG. 2, is an integrated circuit ROM 20 in which is digitally stored six different recorded sounds similar to those produced by a cat. Each of these six sounds is read out of the ROM when a related push-button switch is depressed by the player. Thus when push-button **19*a* is depressed, read-out of the ROM is a quasi-musical riff of meows, while when push-buttons 19*b* to 19*e* are depressed in each instance there is read-out of the ROM a riff of meows musically different from the others. Thus one riff of meows may be in the soprano range, another riff in the alto range, and still another in the contralto range, so that no two riffs are musically alike. And when push-button 19*f*** is depressed, there is then produced an assortment of quasi-musical meows.

The digitally recorded sounds read out of ROM 20 when a particular push-button switch is depressed is converted by a digital-to-analog converter 21 to an analog signal. This analog signal is amplified in a solid state amplifier 22 whose output is applied to a miniature loud speaker 23. Speaker 23 is placed within head 10 of the cat adjacent its partially-open mouth 24 so that the sounds emanating from the electronic instrument can be clearly heard.

The player of this hybrid musical instrument, while blowing through mouthpiece 15, can selectively finger the finger holes 16 and the push-buttons 19*a* to 19*f* to produce both acoustic recorder tones and cat-like sounds. And he can intermingle the recorder tones with the cat-like sounds to produce a blend thereof and thereby create an original piece of music.

Figure 3:
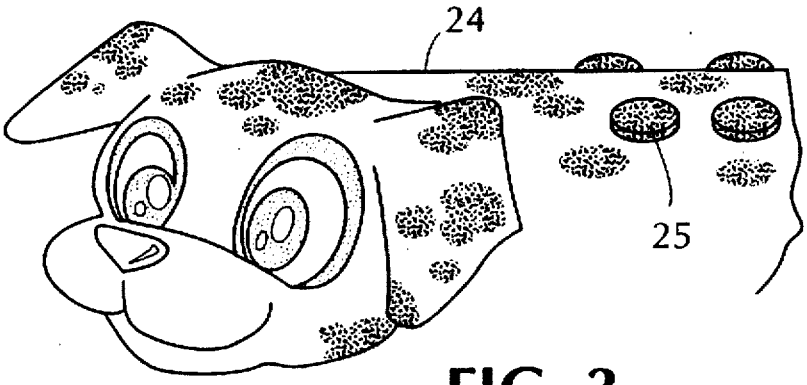
FIG. 3 illustrates a hybrid instrument in accordance with the invention which has the appearance of a dog.

Other Embodiments:

In the dog-like hybrid instrument shown in FIG. 3, the body of the dog has the spots of a Dalmatian, and push-button switches 25 of the electronic musical instrument are registered with these spots and thereby made less conspicuous. In an instrument which has the appearance of a dog, the sounds produced when fingering the buttons are dog-like barks, but in a quasi-musical form. Thus when one button is depressed one hears a series of barks in the soprano range, while when another button is depressed, this produces a series of barks in a baritone range, and so on.

In the hybrid instrument shown in FIGS. 1 and 3, the tail of the animal extends axially from its body so that the body and tail are in a straight line.

Figure 4:
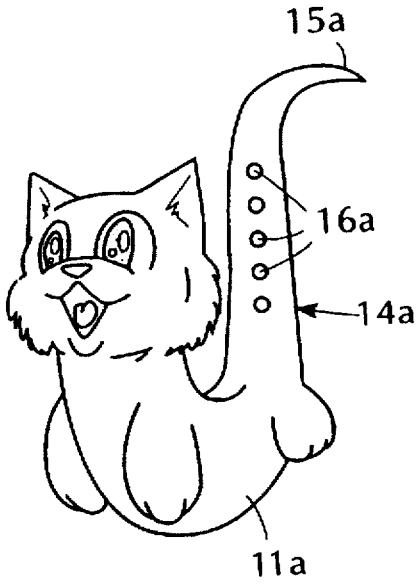
FIG. 4 illustrates a hybrid instrument having the appearance of a cat and shaped to resemble a saxophone.

In the hybrid instrument shown in FIG. 4 which has a cat-like appearance as does the instrument in FIG. 1, body 11A of this instrument and tail 14A extending from the body are shaped to cause the instrument to resemble a saxophone. The tail is provided with a mouthpiece 15A and finger holes 16A so that the tail section functions as an acoustic recorder. The body section, as in the other embodiments, functions as an electronic instrument.

While there has been shown and described preferred embodiments of a hybrid electronic and acoustic musical instrument in accordance with the invention, it will be appreciated that many changes and modifications may be made therein without, however, departing from the essential spirit thereof.

I claim:

1. A hybrid electronic and acoustic musical instrument comprising:

A. a main section and a hollow tail section extending therefrom terminating in a mouthpiece and provided with a series of finger holes to define an acoustic recorder playable by a player who blows into the mouthpiece and fingres the holes; and B. an electronic instrument incorporated in the main section, including a series of push-button switches operable by fingers of the player, a read-out memory having digitally stored therein a like series of different sound effects, and means associated with the switches to extract particular digitally stored sound effects from the memory when a particular switch is operated by the player and to convert the extracted sound effects to an analog signal which is amplified and reproduced to provide audible sound effects, whereby by selectively fingering the finger holes of the recorder and the push-button switches of the electronic instrument, the player can combine the tones of the recorder with the sound effects, the main section having the shape of an animal provided with a head and body, and the tail section extending from the body.

2. An instrument as set forth in claim 1, in which the memory is an integrated circuit and is coupled to a digital-to-analog converter whose output analog signal is fed through an amplifier to a loud speaker.

3. An instrument as set forth in claim 1, in which the animal is a cat and said series of sound effects are each composed of meow sounds of the type produced by a cat.

4. An instrument as set forth in claim 3, in which the meow sounds produced when one push-button switch is operated are musically different from the meow sounds produced when another switch is operated.

5. An instrument as set forth in claim 3, in which the tail section is in axial alignment with the body of the main section.

6. An instrument as set forth in claim 1, in which the body of the main section and the tail section extending therefrom are shaped to simulate the appearance of a saxophone.

7. An instrument as set forth in claim 1, in which the animal is a dog and said sound effects are composed of barking sounds of the type produced by a dog.

8. An instrument as set forth in claim 7, in which the barking sounds produced when one push-button switch is operated are musically different from the barking sounds produced when another switch is operated.

* * * * *